United States Patent [19]

Galomb

[11] Patent Number: 4,999,608

[45] Date of Patent: Mar. 12, 1991

[54] SCREEN FOR BURGLAR ALARMS AND METHOD OF MAKING THE SAME

[76] Inventor: David E. Galomb, P.O. Box A, Trexlertown, Pa. 18087

[21] Appl. No.: 381,961

[22] Filed: Jul. 19, 1989

[51] Int. Cl.[5] ..... G08B 13/02; G08B 13/08

[52] U.S. Cl. ..... 340/550; 340/547

[58] Field of Search ..... 340/550, 547

[56] References Cited

U.S. PATENT DOCUMENTS

| | | | |
|---|---|---|---|
| 3,051,935 | 8/1962 | Willson | 340/550 |
| 3,133,773 | 5/1964 | Ecker | 439/75 |
| 3,594,770 | 7/1971 | Ham et al. | 340/550 |
| 3,609,739 | 9/1971 | Walter | 340/550 |
| 3,909,331 | 9/1975 | Cohen | 340/550 |
| 4,146,293 | 3/1979 | Mutton et al. | 340/550 |
| 4,293,778 | 10/1981 | Williams | 340/550 |

*Primary Examiner*—Glen R. Swann, III

*Attorney, Agent, or Firm*—David E. Galomb

[57] ABSTRACT

An electrically conductive security screen includes an electrical resistance sensor and alarm to detect tampering with the screening material of a window. An elongated path of flexible and electrically conductive coating composition is applied to the screening material in a predetermined and non-overlapping pattern, such that a closed circuit loop is formed when it is attached to the sensor alarm; the coating having an electrical resistance that varies when it is distorted or its path interrupted. The pattern having a marginal section of high electrical resistance and being in series with at least one switch.

24 Claims, 5 Drawing Sheets

SCREEN FOR BURGLAR ALARMS AND METHOD OF MAKING THE SAME

FIELD OF THE INVENTION

The invention relates generally to a method and apparatus for detecting tampering with a window screen, and more particularly to an improved alarm-screen system including a resistance sensing device and alarm connected in series with a path of electrically conductive coating composition applied to a window screen.

BACKGROUND OF THE INVENTION

Prior art burglar alarm systems in the general field typically include a continuous conductive strip of soft tin/lead alloy foil applied to a window or screen. This creates a closed electric circuit which becomes open if the strip tears as a result of someone breaking the window or cutting the screen. A remote sensor and alarm detects the open circuit and signals an intrusion. Such systems provide a basic level of protection but there are inherent drawbacks.

First of all, the foil strip is extremely unsightly when applied to the window or screen and also alerts potential intruders of a protective system.

Second, the foil strip often fails to adhere to the window or screen surface as a result of long-term exposure to the sun's rays and moisture condensation.

Third, sophisticated intruders developed ways of avoiding detection by shunting the foil strip. This bypasses the closed-loop and allows the intruder to break the foil strip without setting off the alarm.

Finally, the foil strip generally could not be bent and therefore had to be pre-cut to span the area of the window or frame. This greatly increased the cost of manufacture and application of the strip.

U.S. Pat. No. 3,909,331 issued to Cohen attempted to solve the first of the foregoing problems by using precut ornamental foil strips. These strips formed ornamental designs on the windows and frames. Although this may have been an improvement of sorts, it came at the cost of significantly higher manufacturing expenses. Moreover, the more serious prior art problems still existed.

More sophisticated alarm screens were developed such as those presented in U.S. Pat. No. 4,293,778 issued to Williams, and U.S. Pat. No. 4,146,293 issued to Mutten et al. These inventions included a continuous conductive strand interwoven throughout the screen mesh of a window screen.

These inventions were undetectable by outward appearance because the interwoven wire was indistinguishable from the surrounding screen mesh. However, the wires are very fragile and have little practical application. A more substantial (and hence, visible) wire is needed. In addition, manufacturing costs are extremely high. Furthermore, these alarm systems must be installed during the original manufacture of the window screen. They cannot be retrofit on a preexisting screen nor applied to any non-conducting standard screen (bug mesh) as is possible with the present invention.

U.S. Pat. No. 3,609,739 issued to Walter suggests a method of applying an electrically conductive lacquer strip to a pane of glass. The strip dries into an opaque closed circuit alarm path which triggers a remote alarm when the glass and lacquer is broken. This improvement yields a virtually undetectable alarm system which can be retrofit to existing windows. In addition, the conductive strip is relatively inexpensive to apply. However, the invention is specifically designed for application to a glass surface.

It would be preferable if an equally effective system could be installed in a window screen rather than glass pane. Since the screen can remain in place with the window open or closed occupants can freely open windows for fresh air without sacrificing protection.

Unfortunately the Walter improvement does not lend itself well to window screens. It is designed to be effective only when an intruder breaks the glass or attempts to shunt the circuit. The device relies on the travelling effect of cracks in glass. It relies on a sensitive thin lacquer strip which severs when interrupted by a travelling crack. This principle is inapplicable to screens. For application to screens there is a clear need for a "lacquer strip" or flexible conductive path which is capable of triggering an alarm when the screen is flexed, jimmied, or otherwise manipulated, in addition to being cut.

In accordance with the broad teachings of the present invention, there is herein, illustrated and described.

SUMMARY OF THE INVENTION

It is therefore an object of this invention to use an electrically conductive coating composition in a normally-closed-circuit window alarm screen system.

It is another object of this invention to use a path of electrically conductive coating composition that varies in electrical resistance when it is interrupted, stretched, or in any way deformed, such that a sensing alarm will detect cutting of the screen as well as any and all tampering short of cutting.

It is another object of this invention to make use of an electrically conductive coating composition applied to the screen mesh in intricate and varied patterns, thereby making the system less susceptible to tampering than all prior art.

It is another object of this invention to use a magnetic reed switch in a series relationship with the path of conductive coating to prevent tampering with the screen frame.

It is another object of this invention to provide a connector means that will accommodate attachment to a conventional alarm sensing device.

It is another object of this invention to use an overcoating for electrical insulation and improved weatherability of the conductive coating.

It is a further object of this invention to provide an alarm screen system that is less visible than any disclosed in the prior art.

It is another object of this invention to provide an alarm screen system that can be installed at the time of manufacture of the window or door screen, or on a retrofit basis to an existing bug screen.

It is another object of this invention to provide an alarm screen system which can be manufactured in less time and at less cost than the prior art, and lends itself to automated production methods.

It is another object of this invention to provide an alarm screen system that eliminates the need for concealing circuitry in a screen frame.

It is a further object of this invention to provide a method to detect tampering with a window or door screen wherein a conductive coating composition is applied to the screen mesh in a predetermined pattern and is used in cooperation with an electrical-resistance-sensing alarm, such that the alarm is triggered when the pattern is interrupted.

The invention which carries out the foregoing objects comprises an electrically conductive security screen for use in a window frame and cooperating with a closed circuit intrusion alarm system, including an electrical-resistance-sensing and alarm means to detect tampering with the screening material and its embodying frame.

The screen apparatus includes a frame defining a window aperture, screen material comprising a mesh of interwoven non-conductive strands covering the window aperture, flexible retaining means for securing the outer periphery of the screening material to the inner periphery of the screen frame, an elongated path of flexible electrically conductive composition applied to the screening material in a predetermined non-overlapping pattern of electrical continuity.

The path has a first end and a second end and is in electrical series with a magnetic reed switch in the screen frame. The coating composition overlies and is bonded to the screening material in a predetermined pattern and has an electrical resistance which varies when the coating composition is distorted or its path is interrupted.

The connector means includes a first wire and a second wire making respective electrical contact with the first and second ends of the conductive path. In this manner the connector means removably interconnects the conductive coating path in series with an electrical-resistance-sensing alarm means.

An overcoating is applied to the screening material to electrically insulate and improve the weatherability of the conductive coating composition.

These and other objects and advantages of the present invention will become apparent from a reading of the following specification, taken in conjunction with the enclosed drawings.

DETAILED DESCRIPTION OF THE PREFERRED EMBODIMENT

Figure 1:
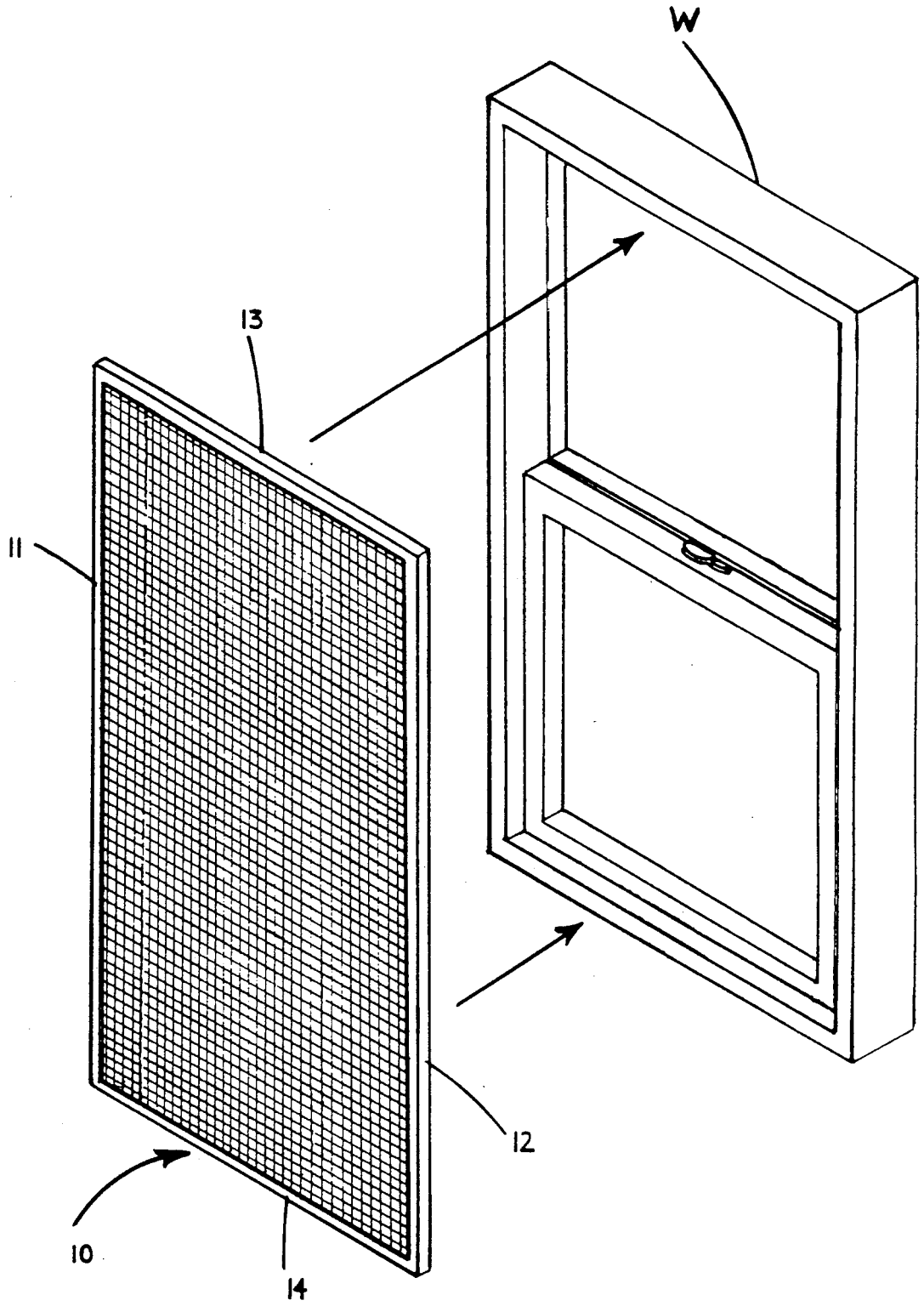
FIG. 1 is a perspective view showing a typical window with the screen in a removed position.

FIG. 1 shows a typical use of a security screen as it is installed in a window W.

Figure 3:
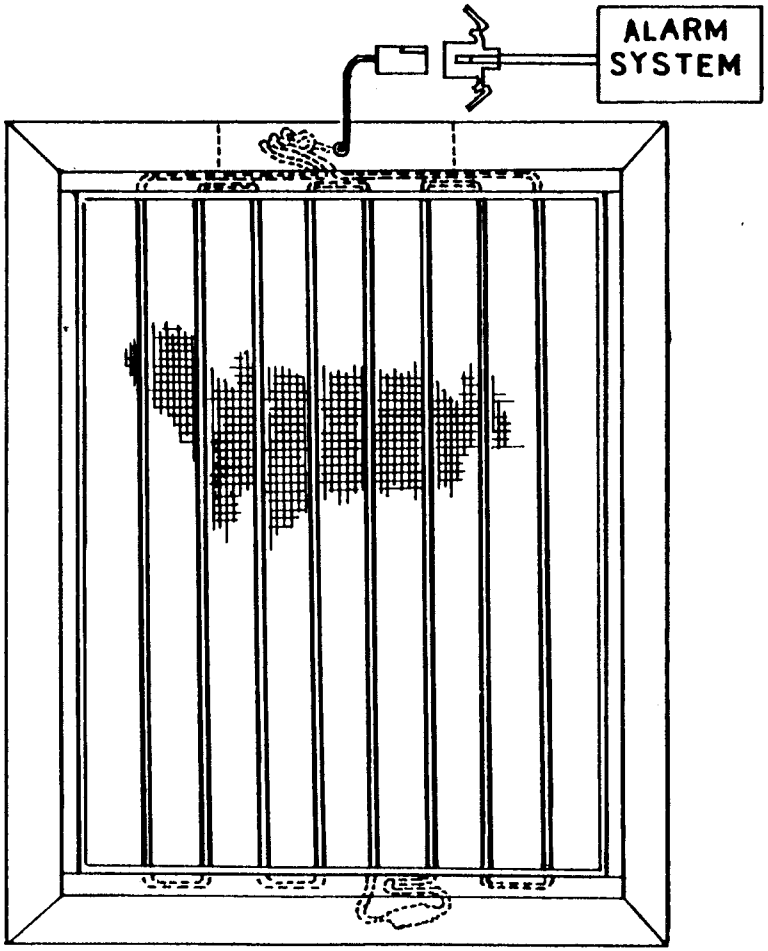
FIG 3 PRIOR ART
FIG. 3 is a front elevational view of the prior art showing a conductive wire mounted on a screen.
Figure 2:
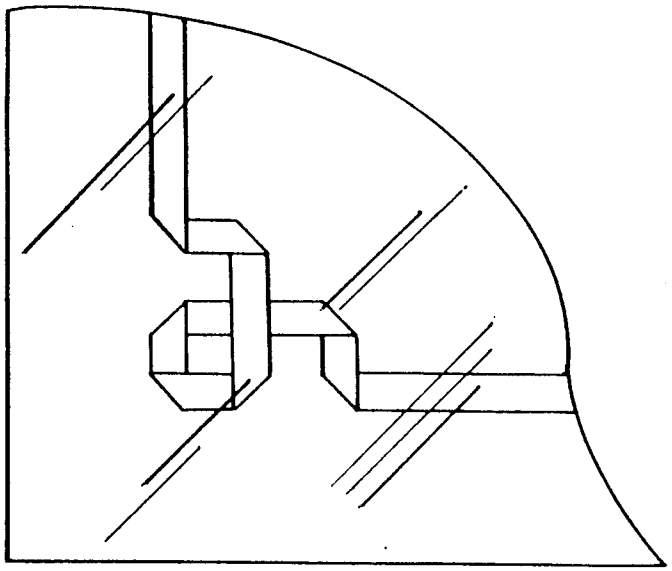
FIG 2 PRIOR ART
FIG. 2 is a front elevational view of prior art showing the metallic foil on a glass pane.

In the prior art, FIG. 2, a conductive strip is mounted on the glass of a window. FIG. 3 illustrates an alarm screen using visible wires.

Figure 4:
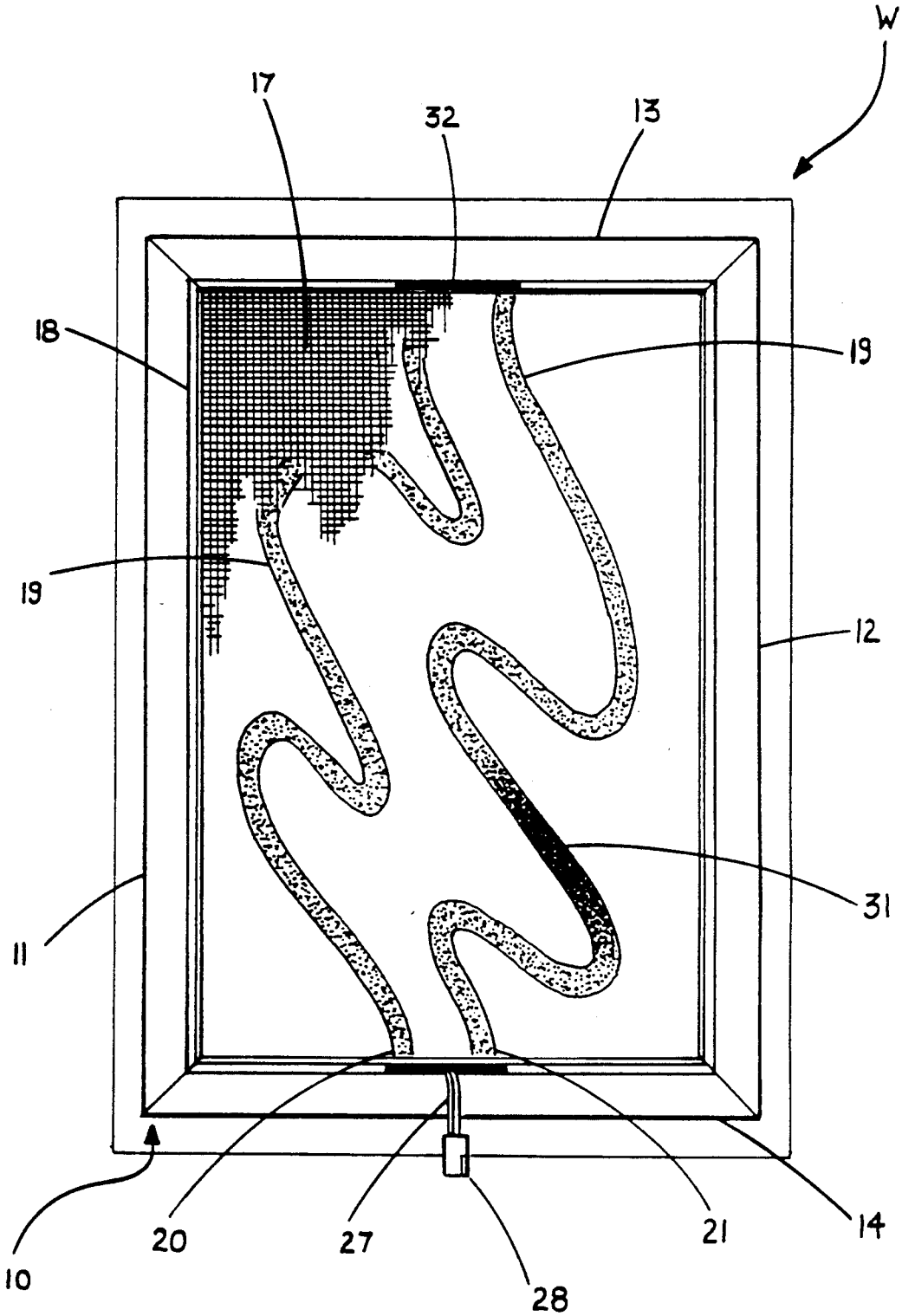
FIG. 4 is a plan view of a screen showing the conductive coating placed in series with a magnetic reed switch, and a plug for connection to a sensor (with screen mesh deleted for clarity).
Figure 5:
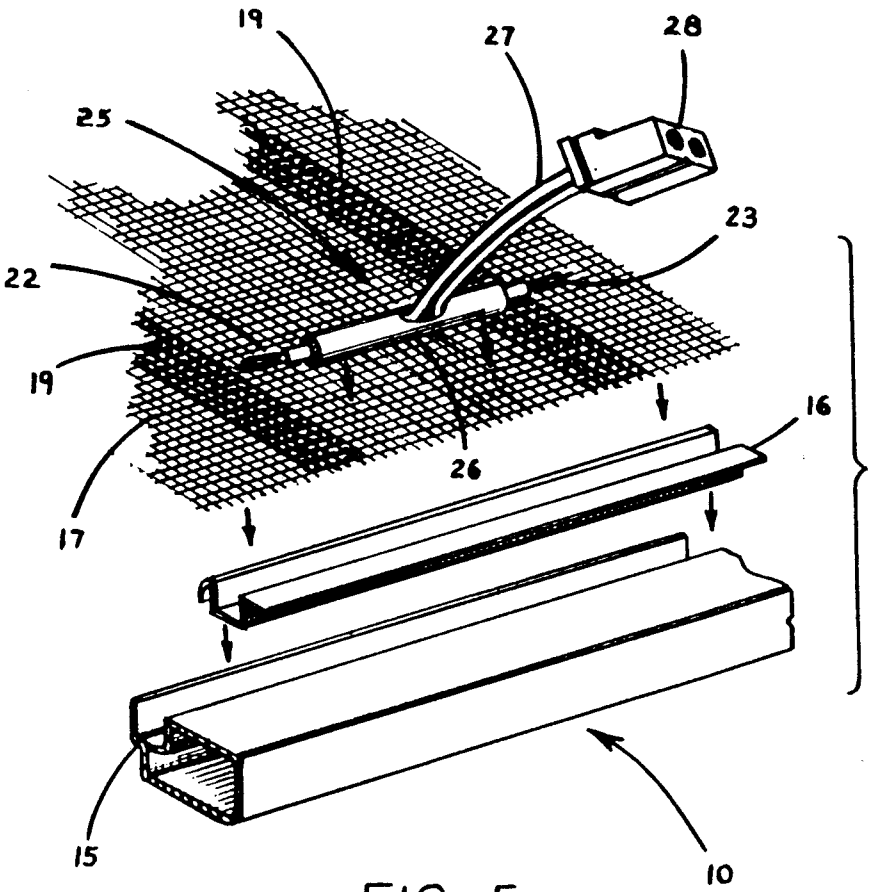
FIG. 5 is an enlarged perspective view showing the connection of the conductive coating to the plug and the disposition of the connection in the screen frame.

Referring to FIG. 4, a conventional window screen assembly includes a rectangular frame 10 comprising a first vertical side 11, a second vertical side 12, a first horizontal side 13, and a second horizontal side 14. As shown in FIG. 5, a cross-sectional view of the frame 10 illustrates that the inside periphery of the frame is formed into a notch 15. A resilient barrier 16 fits inside and acts as a lining therefore. A rectangular section of non-conductive screening mesh 17 is stretched across the frame 10. The outer periphery of the screen mesh 17 is secured inside the plastic barrier 16 and notch 15 of the frame 10 by a flexible retaining spline 18 which is pressed into the resilient barrier 16 over the edges of the screen mesh 17.

Figure 6:
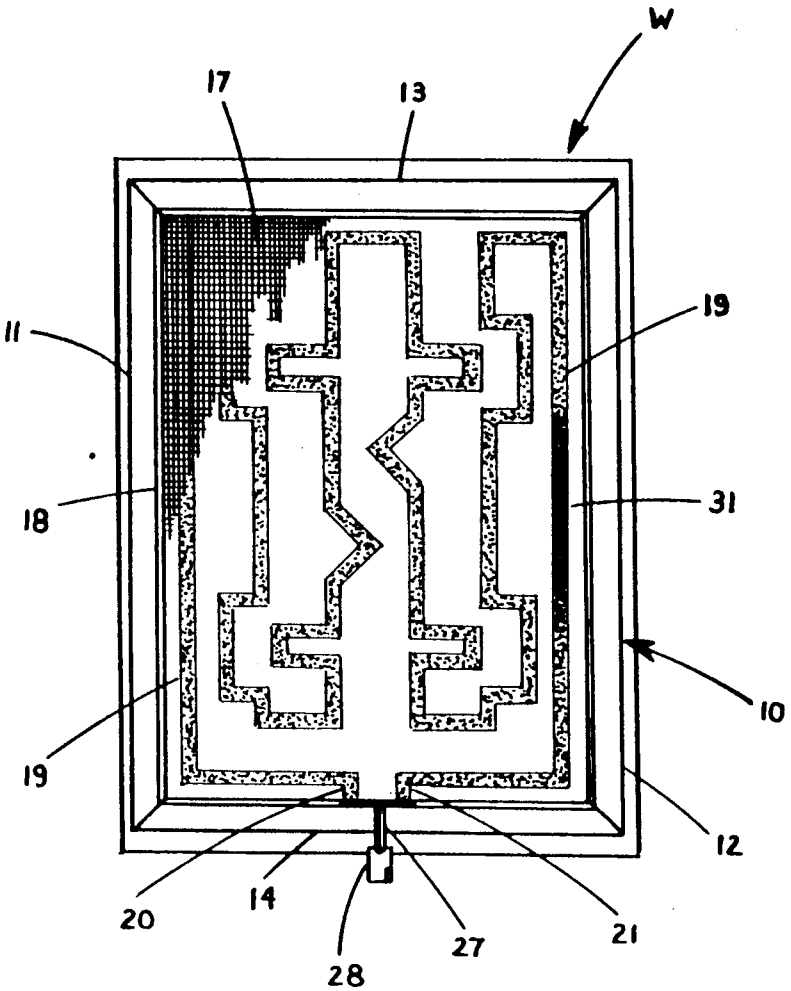
FIG. 6 is a plan view of another embodiment of the security screen in which the conductive coating is disposed in a continuous pattern on the screen mesh and attached to a plug for connection to a sensor (with screen mesh deleted for clarity).

Referring to FIG. 4 and FIG. 6, a thin path of electrically conductive coating composition 19 is applied directly to the screen mesh 17 beginning adjacent to the second horizontal side of the screen frame 14 at point 20 and extending outwardly therefrom in a desired pattern until terminated adjacent to he second horizontal side of the screen frame 14 at point 21 also being relatively close to point 20.

An elastomeric conductive coating composition of silver suspension particles which has been used successfully for this application is available at Emerson & Cuming, Canton, Massachusetts sold under the trade name "ECCOCOAT CC-40". It cures at room temperature and remains flexible after it has cured. It is understood that this product is identified for example purposes only and is in no manner a limitation.

The conductive coating may be translucent or may be pigmented to make it less visible when it is applied to the screen mesh. The term "coating" is used in a general sense and is meant to include conductive paints, as well as conductive inks. This term further includes any electrically conductive composition that coats, bonds, or in any way interacts with the substrate.

A section 31 of the conductive path 19 is substituted with a conductive coating composition of measurably greater electrical resistance than the aforementioned conductive coating, thus increasing the overall electrical resistance of the entire circuit. An attempt to bypass the system by shunting the circuit will effectively alert a sensing device, caused by a variance in resistance.

An elastomeric carbon-based conductive coating composition that has been used successfully for this purpose is available at Emerson & Cuming, Canton, Massachusetts sold under the trade name "ECCOCOAT 258-A". This product is identified for example purposes only, and as for all trade name products herein referenced to, are by no means a limitation.

The conductive coating composition is applied by hand using an ordinary foam brush, or with machinery for speedier production methods, in a predetermined pattern (FIG. 4 and FIG. 6). The intricacy of the pattern and the width of the conductive path regulate the degree of protection that is provided.

Referring now to FIG. 4, in one preferred embodiment the path of conductive coating composition 19 is interrupted along the first horizontal side of the screen frame 13 where it is adhered to and bridged in electrical series by a magnetic reed switch 32 resting in the plastic barrier 16 secured in the screen frame notch 15. The magnetic reed switch 32 is designed to open the electrical circuit if the screen frame 10 is removed from its position in the window W.

Figure 7:
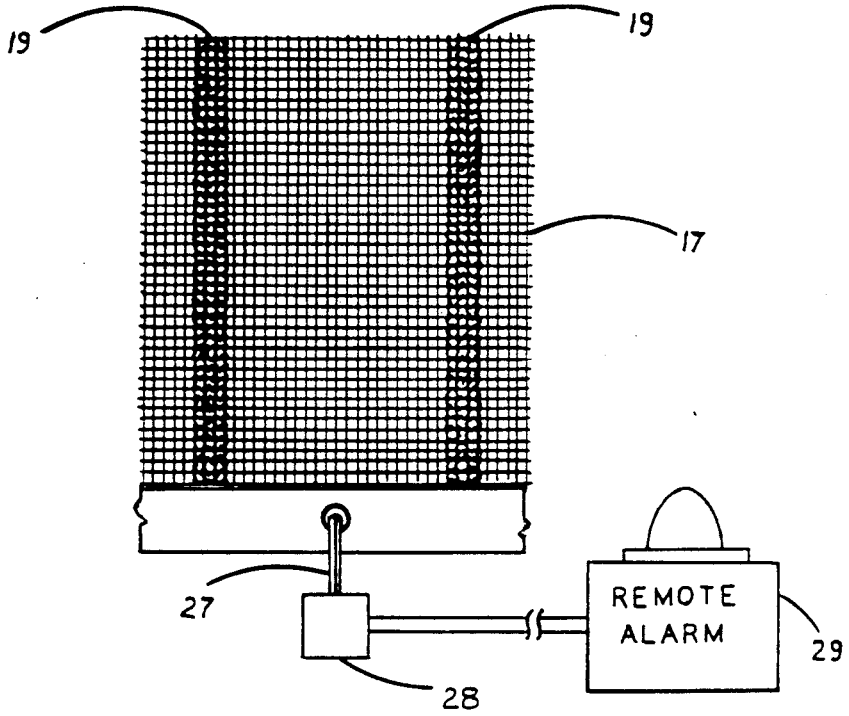
FIG. 7 is a plan view showing connection of the conductive path on the screen with a sensor alarm.
Figure 8:
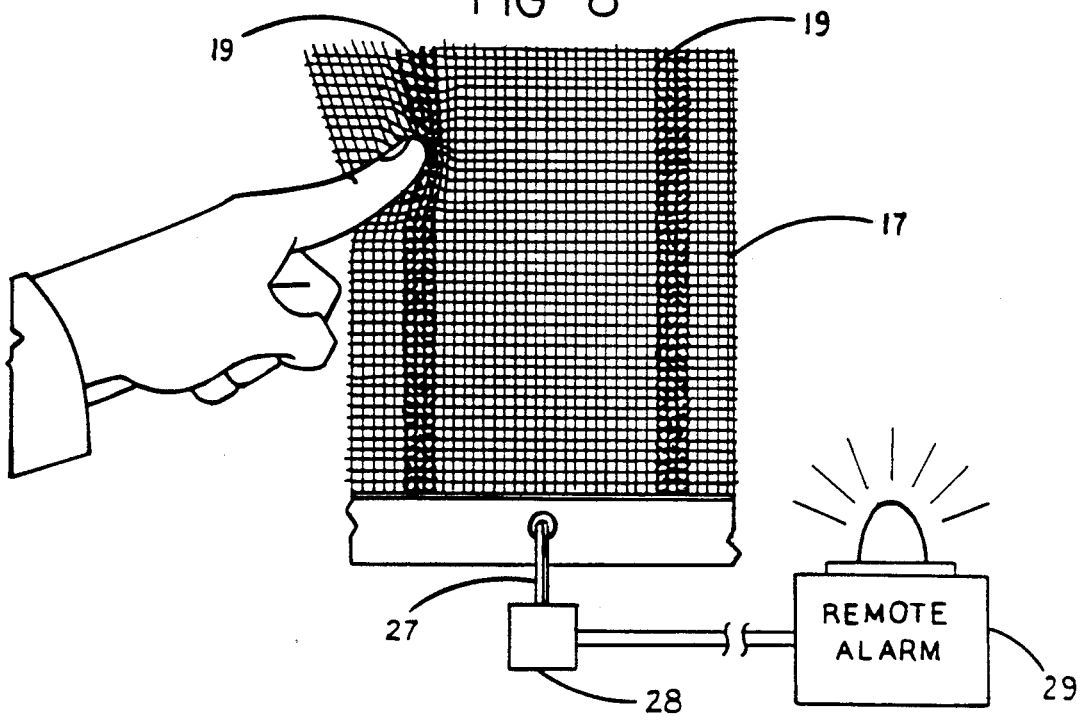
FIG. 8 is a plan view showing tampering with the conductive coating thereby activating the sensor alarm.

Referring to FIG. 5, a first conventional conductive means such as an insulated copper wire 22 and likewise a second conventional conductive means 23 are inserted into a flexible connector sleeve 25. The connector sleeve 25 is shaped generally in a T-configuration with a horizontal member 26 and a vertical member 27 intersecting the horizontal member approximately at its midpoint. The first conductive means 22 extends about one-half inch (½') past one end of the horizontal member 26 and alternately the second conductive means 23 extends about one-half inch (½') past the other end of the horizontal member 26. The first and second conductive means 22, 23 converge on each other and are angled down the vertical member 27 of the connector sleeve 25 running together in a parallel manner and terminating at a dual plug or socket 28 for connection to a resistance-sensing alarm 29 (FIG. 7).

A section of the flexible retaining spline 18 is removed between the beginning of the conductive path 20 and the end point of the conductive path 21. The assembled connector means 25 is inserted into the exposed section of the resilient barrier 16 pressed into the screen frame notch 15 and in this manner the horizontal member 26 of the assembled connector means 25 is generally acting as a substitute retaining spline.

The beginning point 20 of the conductive path 19 is adhered to the exposed end of the first conventional conductive means 22. Likewise the end point 21 of the conductive path 19 is adhered to the exposed end of the second conventional conductive means 23.

The wires 22, 23 are each adhered to the conductive path 19 by means of a small amount of electrically conductive epoxy compound or any other effective electrical connector. Likewise a reed switch 32 may also be adhered to the conductive path 19 in the same manner. A silicone sealer is applied over the connection joints for electrical insulation and protection from the elements.

A protective overcoating is sprayed onto or otherwise applied to the screen mesh 17 to electrically insulate and improve the weatherability of the conductive coating. The overcoating may be pigmented to further conceal the conductive path 19.

Protective coatings of this type are readily available.

The end result is an improved electrically conductive security screen that removably connects to a conventional sensing alarm 29 by means of a dual plug 28 in such a way that tampering with the screen by distortion of the mesh 17 or actual interruption of the conductive path 19 cause the sensing alarm 29 to be activated.

The connector means 25 described herein is designed to cooperate with alarm sensing devices commonly used today. It is obvious that any sensing device may be used with this improvement simply by making electrical contact with each end of the conductive path such that a continuous loop is formed. A sensing device may be remotely located or embodied in the screen frame. The sensor means may connect directly to the alarm device or be separate as in the case of a wireless interface. The alarm sensing device may be removably connected or permanently attached to the conductive path 19. Also conductance as well as resistance may be measured.

Practical application of the prior art methods for making alarm screens use visible wires woven into or sewn onto the bug mesh in which all the mesh is of a standard type, and the wires are spaced apart vertically a standard four inches (4'). These prior art methods are labor intensive to weave the wires to the screening material, and then to join them together in order to form a continuous loop.

Contrary thereto, the present invention teaches an easily applied conductive coating composition that can be used with any non-conductive screening material, typically fiberglass bug mesh coated with PVC. The conductive coating composition may be applied in any desired non-overlapping pattern (FIG. 4 and FIG. 6) and does not rely on a standard pre-wired mesh.

This improvement facilitates competition in the manufacture of alarm screens by allowing manufacturers to offer various degrees of protection simply by altering the pattern of conductive coating.

This system has the additional utility in that the security screen may be employed in a new installation or it may be retrofitted to an existing bug screen.

Accordingly, it will be appreciated by those skilled in the art that many other modifications may be made without departing from the basic spirit of the invention.

What is claimed is:

1. In an electrically conductive security screen apparatus for use in a window frame and cooperating with a closed-circuit intrusion alarm system including an electrical-resistance-sensing means and alarm means to detect tampering with the screening material of a window screen apparatus, said window screen apparatus including a frame defining a window aperture, screening material comprising a non-conductive mesh of interwoven strands covering the window aperture, and flexible retaining means for securing the outer periphery of the screening material to the inner periphery of the screen frame, an improvement comprising;

An electrically conductive coating composition applied to the screening material in a predetermined non-overlapping pattern of electrical continuity, the pattern having a first end and a second end, such that a closed-circuit loop is formed when it is connected in series to said electrical-resistance-sensing means, the pattern having an electrical resistance that varies if it si distorted or its path interrupted.

2. The improvement of claim 1, wherein a connector means removably interconnects the security screen apparatus to the electrical-resistance-sensing means.

3. The improvement of claim 1, wherein the electrically conductive coating composition is pigmented.

4. The improvement of claim 1, wherein the electrically conductive coating composition is substantially translucent.

5. The improvement of claim 1, wherein a section of the conductive pattern is of measurably greater electrical resistance.

6. The improvement of claim 1, wherein the screening material is overcoated to electrically insulate and improve the weatherability of the conductive pattern.

7. The improvement of claim 1, wherein the screening material is overcoated to conceal the conductive pattern.

8. The improvement of claim 1, wherein the conductive pattern is in electrical series with at least one switch in the screen frame.

9. A method of making a window screen security device apparatus, said window screen apparatus including a screen frame defining a window aperture, screening material comprising a mesh of interwoven non-conductive strands covering the window aperture, and flexible retaining means for securing the outer periphery of the screening material to the inner periphery of the screen frame, an improvement comprising;

The application of an elongated path of flexible and electrically conductive coating composition to the screening material creating a predetermined non-overlapping pattern of electrical continuity, the pattern having a first end and a second end, such that a closed-circuit loop is formed when it is connected electrical series to an electrical-resistance-sensing means, the pattern having an electrical resistance that varies if it is distorted or its path interrupted.

10. The improvement of claim 9, wherein a connector means is used to removably interconnect the conductive coating pattern to the sensing means.

11. The improvement of claim 9, wherein the electrically conductive coating composition is pigmented.

12. The improvement of claim 9, wherein the electrically conductive coating composition is substantially translucent.

13. The improvement of claim 9, wherein a section of the conductive coating path is substituted with a flexible and electrically conductive coating composition of measure ably greater electrical resistance.

14. The improvement of claim 9, wherein an overcoating is applied to the screening material to electrically insulate and improve the weatherability of the conductive coating pattern.

15. The improvement of claim 9, wherein an overcoating is applied to the screening material to conceal the conductive coating pattern.

16. The improvement of claim 9, wherein at least one switch in the screen frame is placed in electrical series with the conductive coating pattern.

17. An electrically conductive security screen, for use with a normally-closed-circuit electrical-resistance-sensing alarm device, including screening material comprising a mesh of interwoven non-conductive strands to be disposed about the area to be protected, an improvement comprising;

An electrically conductive coating composition applied to the screening material in a predetermined non-overlapping pattern of electrical continuity, having a first end and having a second end, such that a closed-circuit loop is formed when it is connected in series to said electrical-resistance-sensing alarm, the said pattern having an electrical resistance that varies if it is distorted or its path interrupted.

18. The improvement of claim 17, wherein the security screen removably interconnects with the sensing alarm means.

19. The improvement of claim 17, wherein the electrically conductive coating composition is pigmented.

20. The improvement of claim 17, wherein the electrically conductive coating composition is substantially translucent.

21. The improvement of claim 17, wherein a section of the conductive coating pattern is of measurably greater electrical resistance.

22. The improvement of claim 17, wherein the screening material is overcoated to electrically insulate and improve the weatherability of the conductive coating pattern.

23. The improvement of claim 17, wherein the screening material is overcoated to conceal the conductive coating pattern.

24. The improvement of claim 17, wherein at least one switch is in electrical series with the conductive coating pattern.

* * * * *